US006454189B1

(12) United States Patent
Krishnamurthy

(10) Patent No.: US 6,454,189 B1
(45) Date of Patent: Sep. 24, 2002

(54) REVERSE ACTING NOZZLE VALVE AND FUEL INJECTOR USING SAME

(75) Inventor: Sujay R. Krishnamurthy, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/611,578

(22) Filed: Jul. 3, 2000

(51) Int. Cl.[7] ..... F02M 59/00

(52) U.S. Cl. ..... 239/533.2; 239/533.11; 239/88

(58) Field of Search ..... 239/88–92, 533.2–533.12, 239/590, 530; 123/446, 447, 506

(56) References Cited

U.S. PATENT DOCUMENTS

| | | | | |
|---|---|---|---|---|
| 1,973,666 A | | 9/1934 | Sidney | |
| 2,035,203 A | * | 3/1936 | Smith | |
| 2,244,394 A | | 6/1941 | Hautzenroeder | |
| 2,317,618 A | | 4/1943 | King | |
| 2,912,001 A | | 11/1959 | Green | |
| 2,928,417 A | | 3/1960 | Buckner et al. | |
| 3,339,848 A | | 9/1967 | Geiger | |
| 3,812,829 A | | 5/1974 | McCormick | |
| 3,982,693 A | * | 9/1976 | Hulsing | 239/88 |
| 4,350,301 A | * | 9/1982 | Erwin et al. | 239/533.7 |
| 4,909,444 A | * | 3/1990 | Sczomak | 239/533.4 |
| 5,020,728 A | * | 6/1991 | Linder et al. | 239/533.3 |
| 5,127,584 A | | 7/1992 | Sczomak | |
| 5,282,577 A | | 2/1994 | Neitz | |
| 5,288,025 A | | 2/1994 | Cerny | |
| 5,497,947 A | | 3/1996 | Potz et al. | |
| 5,522,550 A | | 6/1996 | Potz et al. | |
| 5,535,723 A | | 7/1996 | Gibson et al. | |
| 5,720,318 A | * | 2/1998 | Nagarajan et al. | 239/88 |
| 5,884,848 A | | 3/1999 | Crofts et al. | |
| 6,042,028 A | * | 3/2000 | Xu | 239/533.7 |

* cited by examiner

*Primary Examiner*—Henry C. Yuen
*Assistant Examiner*—Dinh Q. Nguyen
(74) *Attorney, Agent, or Firm*—Liell & McNeil

(57) ABSTRACT

A nozzle assembly includes a tip body having a lower end and defining a nozzle outlet. A needle sleeve is at least partially positioned in the tip body and includes a valve seat. A needle valve member is at least partially positioned within the needle sleeve, and is moveable between a closed position in contact with the valve seat and an open position out of contact with the valve seat. The needle valve member moves toward the lower end of the tip body when moving toward its open position. The nozzle assembly finds its preferred application in hydraulically-actuated fuel injectors having direct control needles.

20 Claims, 2 Drawing Sheets

25
26
28
21
20
27
29
31
60
32
41
40
44
61
42
50
30
46
45
22
19
47
48
24
23
18
49
55
10
54
60
52
16
17
11
59
12
56
15
60
57
14
58
51
13
11
73
90

REVERSE ACTING NOZZLE VALVE AND FUEL INJECTOR USING SAME

TECHNICAL FIELD

The present invention relates generally to nozzle assemblies, and more particularly to fuel injectors having reverse acting needle valves.

BACKGROUND ART

In most fuel injectors, a needle valve opens inwardly to open the nozzle of the fuel injector to the combustion space. In a typical example, the nozzle valve member is biased toward its downward closed position in contact with the valve seat by a biasing spring. At the initiation of an injection event, high pressure fuel surrounds the valve member and acts on a lifting hydraulic surface of the valve member. When the pressure of the fuel reaches a valve opening pressure, the valve member can move upward, and thus farther inward, against the action of the biasing spring to open a fuel path from the fuel injector into the combustion space. Toward the end of an injection event, the biasing spring, which may or may not be assisted by a hydraulic closing force, pushes the needle back toward its closing position where it impacts the valve seat to close the nozzle outlet and end the injection event.

In most instances, the metal of the tip component where the nozzle valve seat is located is relatively thin and exposed directly to the hostile combustion space environment. Over its useful life, the needle valve member will impact its valve seat with relatively high loads many millions of cycles. In some instances, the impact load and fatigue stress caused by the closing of the needle valve can sometimes cause tip failures. When this occurs, extensive engine damage can occur because of loose metallic debris from the fuel injector failure finding its way into the combustion space. While these failures are extremely rare, the damage done to an engine can be so profound that engineers are often seeking ways in which the possibility of catastrophic engine damage can be eliminated and the instances of fuel injector nozzle assembly failures reduced.

The present invention is directed to overcoming one or more of the problems set forth above.

DISCLOSURE OF THE INVENTION

A nozzle assembly includes a tip body having a lower end and defining a nozzle outlet. A needle sleeve is at least partially positioned in the tip body and includes a valve seat. A needle valve member is at least partially positioned within the needle sleeve, and is moveable between a closed position in contact with the valve seat and an open position out of contact with the valve seat. The needle valve member moves toward the lower end of the tip body when moving toward its open position. The nozzle assembly finds its preferred application in hydraulically-actuated fuel injectors having direct control needle values.

BEST MODE OF CARRYING OUT THE INVENTION

Figure 1:
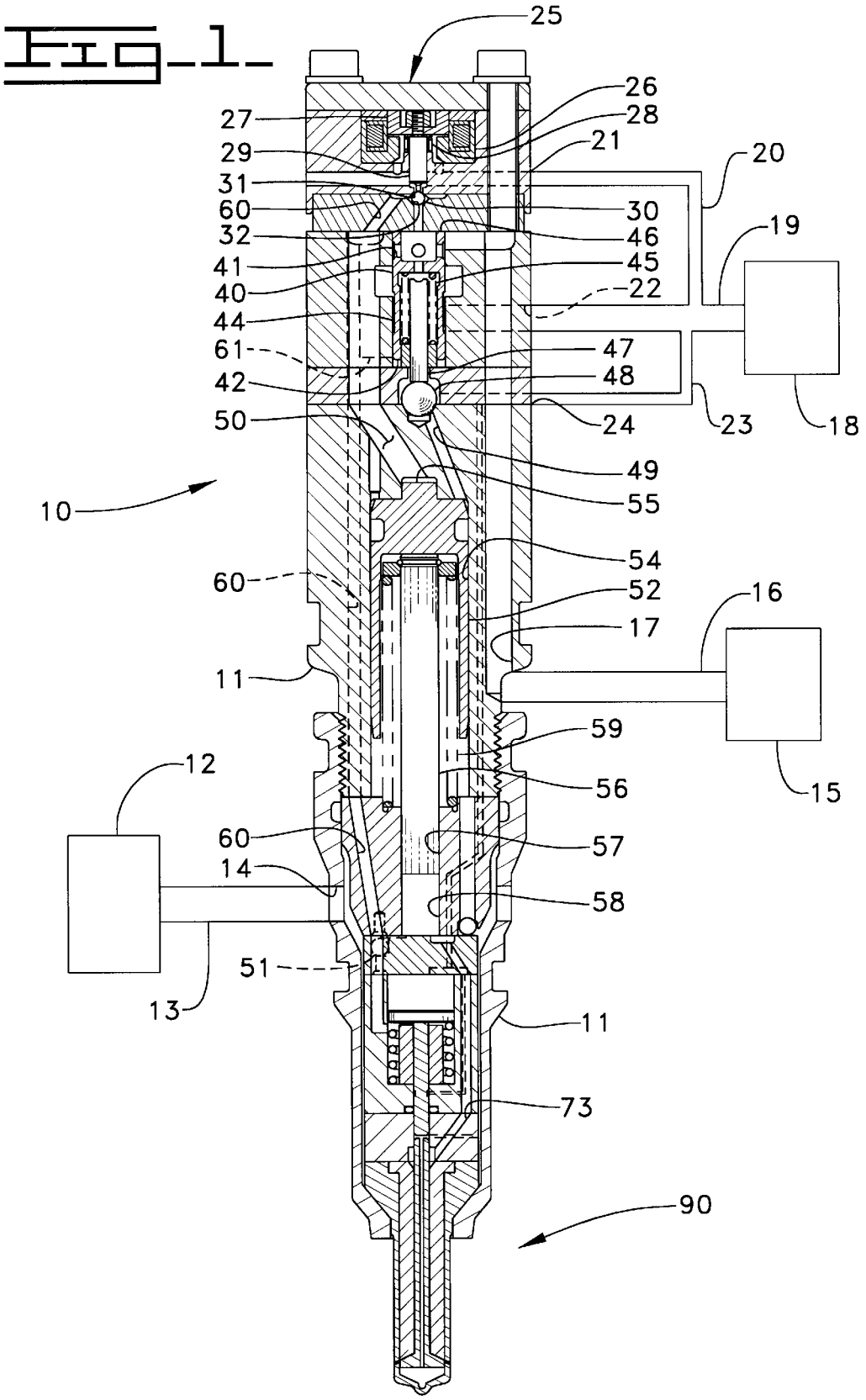
FIG. 1 is a sectioned side diagrammatic view of a hydraulically-actuated fuel injector according to one embodiment of the present invention.

Referring now to FIG. 1, a hydraulically-actuated fuel injector 10 includes an injector body 11 that defines a fuel inlet 14 connected to a source of fuel 12 via a fuel supply line 13. Injector body 11 also defines an actuation fluid inlet 17 connected to a source of high pressure actuation fluid, such as lubricating oil, via a high pressure supply line 16. In addition, injector body 11 defines a first low pressure vent 21, a second low pressure vent 24 and an actuation fluid drain 22 that are fluidly connected to low pressure reservoir 18 via vent passage 20, drain passage 19 and vent passage 23, respectively. As described in several previous patents, such as U.S. Pat. No. 5,682,858 to Chen et al, fuel injector 10 is controlled in its operation by a single electrical actuator 25, which is preferably a solenoid but could be another suitable device such as a piezo electric actuator.

Electrical actuator 25, which is attached to injector body 11 via some suitable means such as bolts, includes a coil 26 and an armature 27 that is attached to a moveable pin 29. Armature 27 and pin 29 are normally biased toward their upward position out of contact with a pilot valve member 30 by a compressed biasing spring 28. Pilot valve member 30, which is preferably a ball valve member but could be some other suitable valve member such as a poppet valve member, is trapped between a low pressure seat 31 and a high pressure seat 32. The area above low pressure seat 31 is fluidly connected to low pressure vent 21 via a hidden passage. The area below high pressure seat 32 is fluidly connected to actuation fluid inlet 17 via intersecting internal passages and the hollow interior of spool valve member 40. When electrical actuator 25 is de-energized, pin 29 is biased toward its upward position out of contact with pilot valve member 30, which is seated in low pressure seat 31 due to the constant high pressure acting on its underside. When electrical actuator 25 is energized, armature 27 and pin 29 move downward pushing pilot valve member 30 to a position that closes high pressure seat 32 and opens low pressure seat 31. A variable pressure control passage 60 opens into the area between low pressure seat 31 and high pressure seat 32.

Pressure control passage 60 includes a branch spool control passage 61 that exposes a control hydraulic surface 42 of spool valve member 40 to the fluid pressure in control passage 60. The positioning of spool valve member 40 controls whether an actuation fluid cavity 50 defined by injector body 11 is open to either high pressure actuation fluid inlet 17 or low pressure actuation fluid drain 22. Spool valve member 40 is normally biased to its upward position, as shown, by a spool biasing spring 45. When in this upward position, actuation fluid cavity 50 is open to low pressure actuation fluid drain 22 via an annulus 44 defined by the outer surface of spool valve member 40. When spool valve member 40 is in its downward position, actuation fluid cavity 50 is open to high pressure actuation fluid inlet 17 via radial passages 41. Spool valve member 40 moves to its downward position when pressure control passage 60 is vented to low pressure such that low pressure is acting on control hydraulic surface 42 but a constant high pressure is acting on opposite end 46. The pressure force exerted on opposite end 46 is preferably greater than the spring force provided by biasing spring 45. When high pressure acts on both control hydraulic surface 42 and opposite end 46, spool valve member 40 is preferably hydraulically balanced such that it will stay at or move to its upward biased position solely under the action of biasing spring 45.

In particular, the positioning of spool valve member 40 controls fluid flow into and out of activation fluid cavity 50, which is in fluid contact with the hydraulic pumping element of injector 10. An intensifier piston 52 includes a hydraulic surface 55 exposed to fluid pressure in actuation fluid cavity 50. Intensifier piston 52 moves in a piston bore 54 defined by injector body 11, but is normally biased toward its upward retracted position by a return spring 59. A plunger 56 moves in a plunger bore 57 and is coupled to the movement of intensifier piston 52. One end of plunger 56 and a portion of plunger bore 57 define a fuel pressurization chamber 58, within which fuel is pressurized to injection pressure levels before and during an injection event. Between injection events, when plunger 56 and piston 52 are undergoing their upward return stroke, fresh low pressure fuel is drawn into fuel pressurization chamber 58 from fuel inlet 14, past check valve 51. Toward the end of an injection event, the high pressure in actuation fluid cavity 50 acting on hydraulic surface 55 is vented to low pressure vent 24 via a pressure relief passage 49 and past a pressure relief ball 48, which is normally in a downward closed position at all other times in the injection cycle.

Figure 2:
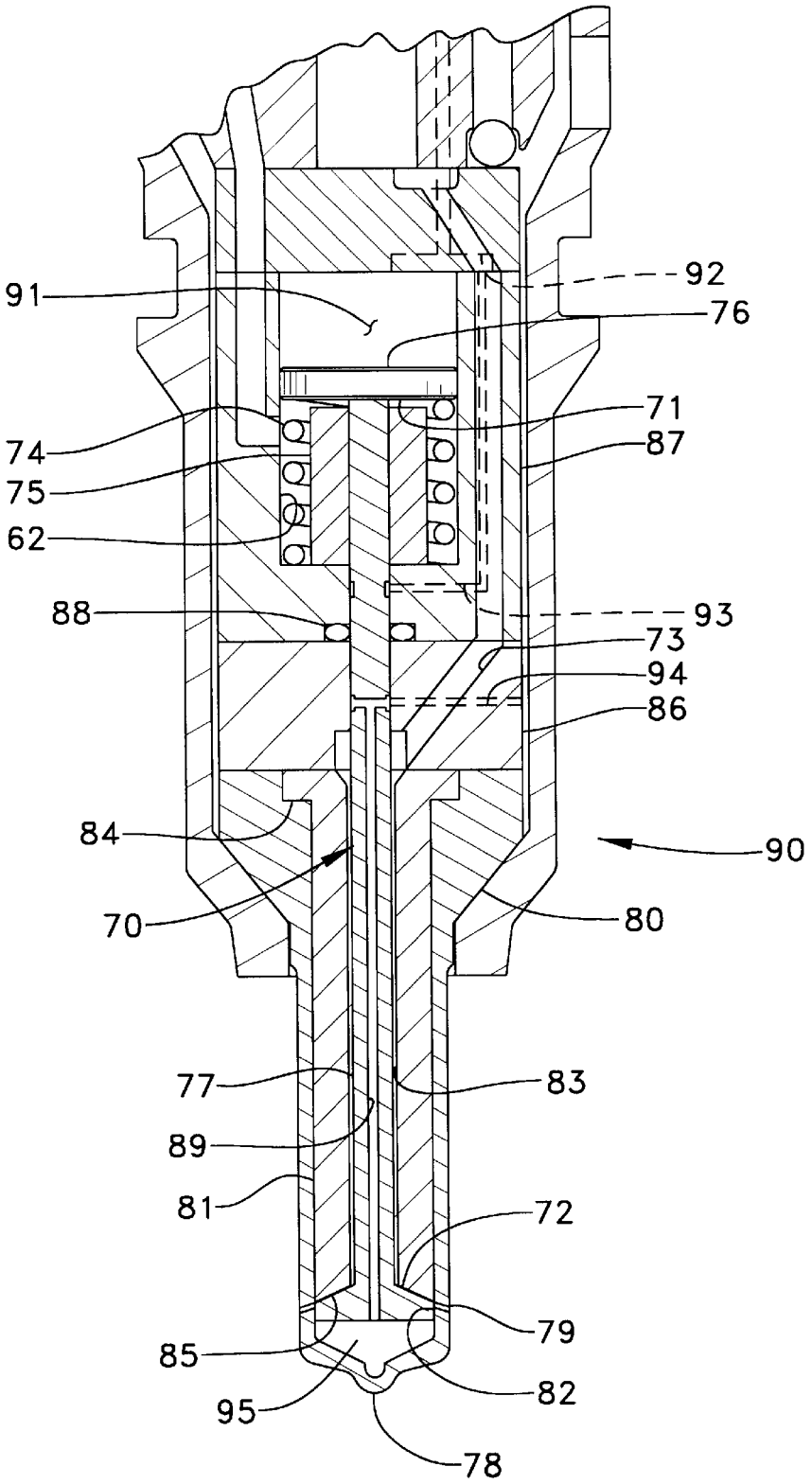
FIG. 2 is a sectioned side diagrammatic view of a nozzle assembly according to the present invention.

Referring now in addition to FIG. 2, fuel pressurization chamber 58 is fluidly connected to a nozzle outlet 79 via a nozzle supply passage 73. A reverse acting direct control needle valve 70 controls the opening and closing of nozzle outlet 79 during an injection event. Direct control needle valve 70 includes a needle valve portion 77 attached to a needle disk 76, a needle stop 75 and a needle biasing spring 74. The opening and closing of direct control needle valve 70 is controlled by fluid pressure in a needle control chamber 62 that is fluidly connected to pressure control passage 60. Direct control needle valve 70 includes a closing hydraulic surface 71 exposed to activation fluid pressure in needle control chamber 62, and an opening hydraulic surface 72 exposed to fuel pressure in nozzle supply passage 73. The pressure of the actuating fluid, the pressure of the fuel fluid, the relative sizes of the closing and opening hydraulic surfaces and the strength of needle biasing spring 74 are chosen such that the direct control needle valve 70 moves toward, or remains in, its upward closed position when pressure in needle control chamber 62 is high. When pressure in needle control chamber 62 is low, the needle valve member will move downward toward lower end 78 to open nozzle outlet 79 when fuel pressure in nozzle supply passage 73 is at or above a valve opening pressure that is sufficient to overcome the biasing force produced by needle biasing spring 74.

The nozzle assembly 90 portion of fuel injector 10 is preferably made up of several components, including a tip component 80, a needle sleeve 81, a check guide component 86 and a spring sleeve component 87. As shown in FIG. 2, the needle valve portion 77 of direct control needle valve 70 is partially positioned within needle sleeve 81, which itself is positioned within tip component 80. Needle sleeve 81 is fixed in a known position by the inclusion of a flange 84 that is positioned between check guide component 86 and tip component 80. So that needle valve portion 77 can be guided within needle sleeve 81 while still permitting the flow of fuel from nozzle supply passage 73 to nozzle outlet 79, sleeve 81 might include a plurality of radially inward projecting needle guides that are spaced apart by fuel flow passages.

In order to control the opening and closing of nozzle outlet 79, needle sleeve 81 includes a conical valve seat 85 on one end. Thus, FIG. 2 shows needle valve portion 77 seated against conical valve seat 85 to close nozzle outlet 79. Nozzle outlet 79 opens to commence the spraying of fuel when needle valve portion 77 moves toward lower end 78 out of contact with conical valve seat 85. The distance that needle valve portion 77 moves is controlled by the height of needle stop 75. In other words, the underside of needle disk 76 comes in contact with needle stop 75 when needle valve portion 77 has moved to its completely open position. Preferably, needle valve portion 77 never comes into contact with tip component 80.

In the preferred embodiment of the present invention, lubricating oil is utilized as the actuation fluid, and distillate diesel fuel is the preferred fuel fluid. In order to inhibit the mixing of these two fluids in the nozzle assembly 90, an o-ring seal 88 is positioned between check guide component 86 and spring sleeve component 87. In addition, a low pressure oil vent 93 channels oil that migrates down the outer surface of nozzle valve portion 77 back for recirculation. Likewise, a low pressure fuel vent 94 channels fuel that migrates upward along needle valve portion 77 back for recirculation. Finally, a low pressure oil vent 92 is provided to vent internal space 91 in order to prevent hydraulic locking of the direct control needle valve.

Industrial Applicability

Referring back to FIG. 1, between injection events, electrical actuator 25 is de-energized, direct control needle valve is in its downward closed position, the pumping elements of piston 52 and plunger 56 are in their upward retracted positions, spool valve member 40 is in its upward position opening actuation fluid cavity 50 to drain 22, and pilot valve member 30 is in its upward position closing low pressure seat 32. When these components are in these positions, low pressure prevails in actuation fluid cavity 50, fuel pressure throughout the injector is relatively low, but pressure in pressure control passage 60, and hence spool control passage 61 and needle control chamber 62 are high. Each injection event is initiated by energizing solenoid 25. This moves pilot valve member 30 downward to close high pressure seat 32 and open low pressure seat 31. This vents pressure control passage 60 to low pressure vent 21. When this occurs, direct control needle valve 70 remains in its closed position under the action of biasing spring 74 because fuel pressure within fuel injector 10 is still relatively low. The opening of pressure control passage 60 to low pressure, however, causes spool valve member 40 to become hydraulically imbalanced and it moves downward against the action of biasing spring 45. As it approaches its downward position, radial passages 41 open actuation fluid cavity 50 into fluid communication with high pressure actuation fluid inlet 17 and annulus 44 closes to cavity 50. When this occurs, high pressure oil begins acting on the top hydraulic surface 55 of piston 52, causing it and plunger 56 to begin their downward stroke. As fuel pressure rises, check valve 51 closes and fuel pressure in fuel pressurization chamber 58 rises rapidly to injection levels. When fuel pressure in nozzle supply passage 73 exceeds the valve opening pressure, needle valve portion 77 moves downward to open nozzle outlet 79.

Those skilled in the art will appreciate that if higher fuel pressures are desired at the onset of injection, the solenoid 25 can be briefly de-energized to repressurize pressure control passage 60 to hold direct control needle valve 70 closed as fuel pressure continues to build in fuel pressurization chamber 58. The brief deenergization of solenoid 25 causes spool valve member 40 to again become hydraulically balanced and begin moving upward under the action of biasing spring 45. However, because spool valve member 40 is relatively sluggish in its movement relative to that of the quick acting pilot valve member 30, the present invention has the ability to produce split injections, or to start an injection event at fuel pressures substantially higher than the established valve opening pressure. The top hat shape of intensifier piston 52 permits some front end rate shaping such as the ability to produce ramp and/or boot shaped front end injection profiles.

During the main portion of each injection event, solenoid 25 remains energized, and low pressure prevails in pressure control passage 60. Shortly before the desired end of the injection event, solenoid 25 is de-energized to repressurize pressure control passage 60. This causes direct control needle valve 70 to abruptly close under the combined forces produced by hydraulic pressure acting on closing hydraulic surface 71 and biasing spring 74. At the same time, spool valve member 40 begins moving upward under the action of biasing spring 45. As it moves, pressure relief ball 48 lifts off of its seat and vents pressure in actuation fluid cavity 50 into low pressure vent 24. When spool valve member 40 reaches its upward position opening annulus 44 to cavity 50, the action of return spring 56 pushes the used low pressure actuation fluid out of cavity 50 and into drain 22 for recirculation. At the same time, the retracting action of plunger 56 draws fresh fuel into fuel pressurization chamber 58.

Those skilled in the art will appreciate that because needle valve member 77 preferably never comes in contact with tip component 80, the likelihood of tip breakage is virtually eliminated. Thus, the likelihood of metal fragments making their way into the combustion space due to injector failure is substantially reduced. In addition, because the needle valve seat 85 is machined on one end of needle sleeve 81, the impact loads on the seat 85 are transferred along the length of needle sleeve 81 and dissipated into the relatively heavier components of injector 10 such as upper check guide 86. This contrasts with conventional check designs that transfer needle impact loads to the relatively thin metal area at the lower end of their tip components.

In the preferred embodiment, the needle valve member, which includes needle portion 77 and needle disk 76, is longer than needle sleeve 81. In addition, the outer diameter of the opposite ends of the needle valve member are preferably larger than the internal diameter of needle sleeve 82. The nozzle assembly 90 is therefore assembled by first positioning needle valve portion 77 in tip component 80. Next, needle sleeve 81 is slid down the shaft of needle valve portion into its desired position. The upper check guide is then slid over needle valve portion 77 or upper check guide 86 is slid over needle valve portion 77 into contact with both tip component 80 and the flange 84 of needle sleeve 81. The o-ring is then placed over needle valve portion 77 and the spring sleeve component 87 is slid over needle valve portion 77. Next, needle stop 75, which is preferably cylindrical in shape, is slid down into its position as shown surrounding needle valve portion 77. Biasing spring 74 is then appropriately positioned, and disk piece 76 is attached to the upper end of needle valve portion 77 in a suitable manner such as via a press fit or threaded engagement. This preferred construction results in a needle valve member that is longer than the needle sleeve 81, and results in the valve opening surface 72 of the needle valve member being exposed to fluid pressure within the needle sleeve.

It should be understood that the above description is intended for illustrative purposes only, and is not intended to limit the scope of the present invention in any way. For instance, while the present invention has been illustrated in the context of a hydraulically actuated fuel injector with a direct control needle valve, those skilled in the art will appreciate that the reverse acting check of the present invention could be utilized in virtually any fuel injector application, including but not limited to cam actuated fuel injectors and other fuel injectors not having direct control needles. Thus, those skilled in the art will appreciate the various modifications could be made to the disclosed embodiments without departing from the intended scope of the present invention, which is defined in terms of the claims set forth below.

What is claimed is:

1. A nozzle assembly comprising:

a tip body having a lower end and defining a nozzle outlet;

a needle sleeve at least partially positioned in said tip body and including a valve seat;

a needle valve member at least partially positioned within said needle sleeve and being movable between a closed position in contact with said valve seat and an open position out of contact with said valve seat; and said needle valve member moving toward said lower end when moving toward said open position.

2. The nozzle assembly of claim 1 wherein said needle valve member is longer than said needle sleeve.

3. The nozzle assembly of claim 1 wherein said needle valve member includes an opening hydraulic surface exposed to fluid pressure within said needle sleeve.

4. The nozzle assembly of claim 1 wherein said tip body partially defines a needle control chamber; and said needle valve member includes a closing hydraulic surface exposed to fluid pressure in said needle control chamber.

5. The nozzle assembly of claim 1 further comprising a compression spring operably positioned in said tip body to bias said needle valve member toward said closed position.

6. The nozzle assembly of claim 1 wherein said valve seat is located on one end of said needle sleeve.

7. The nozzle assembly of claim 1 wherein said tip body includes a tip component defining said nozzle outlet and an upper component abutting said tip component; and an upper end of said needle sleeve being in contact with said upper component.

8. A fuel injector comprising:

an injector body including a tip component having a lower end and defining a nozzle outlet and an upper component abutting said tip component;

a needle sleeve positioned in said injector body and including a valve seat, and an upper end of said needle sleeve being in contact with said upper component;

a needle valve member at least partially positioned within said needle sleeve and being movable between a closed position in contact with said valve seat and an open position out of contact with said valve seat, and said needle valve member including an opening hydraulic surface exposed to fluid pressure within said needle sleeve; and said needle valve member moving toward said lower end when moving toward said open position.

9. The fuel injector of claim 8 wherein said needle sleeve has an inside diameter; and said needle valve member has opposite end portions with outside diameters that are greater than said inside diameter.

10. The fuel injector of claim 8 wherein said injector body partially defines a needle control chamber; and said needle valve member includes a closing hydraulic surface exposed to fluid pressure in said needle control chamber and an opening hydraulic surface exposed to fluid pressure within said needle sleeve.

11. The fuel injector of claim 10 further comprising a compression spring operably positioned in said injector body to bias said needle valve member toward said closed position.

12. The fuel injector of claim 8 further comprising a stop component positioned in said injector body at least partially surrounding said needle valve member; and said needle valve member being out of contact with said stop component when in said closed position, and being in contact with said stop component when in said open position.

13. The fuel injector of claim 8 wherein said valve seat is located on one end of said needle sleeve.

14. The fuel injector of claim 8 wherein said needle valve member is out of contact with said tip component when in said closed position and said open position.

15. A hydraulically actuated fuel injector comprising:

an injector body that defines a fuel pressurization chamber and an actuation fluid cavity, and includes a tip component having a lower end and defining a nozzle outlet;

a pumping element that includes a first hydraulic surface exposed to fluid pressure in said actuation fluid cavity, and an opposing hydraulic surface exposed to fluid pressure in said fuel pressurization chamber;

a needle sleeve positioned in said injector body and including a valve seat;

a needle valve member at least partially positioned within said needle sleeve and being movable between a closed position in contact with said valve seat and an open position out of contact with said valve seat, and said needle valve member being out of contact with said tip component when in said closed position and said open position; and said needle valve member moving toward said lower end when moving toward said open position.

16. The hydraulically actuated fuel injector of claim 15 wherein said injector body partially defines a needle control chamber; and said needle valve member includes a closing hydraulic surface exposed to fluid pressure in said needle control chamber and an opening hydraulic surface exposed to fluid pressure within said needle sleeve.

17. The hydraulically actuated fuel injector of claim 16 wherein said valve seat is located on one end of said needle sleeve.

18. The hydraulically actuated fuel injector of claim 17 wherein said injector body includes an upper component abutting said tip component; and an upper end of said needle sleeve being in contact with said upper component.

19. The hydraulically actuated fuel injector of claim 18 further comprising a stop component positioned in said injector body at least partially surrounding said needle valve member; and said needle valve member being out of contact with said stop component when in said closed position, and being in contact with said stop component when in said open position.

20. The hydraulically actuated fuel injector of claim 19 wherein said needle sleeve has an inside diameter; and said needle valve member has opposite end portions with outside diameters that are greater than said inside diameter.

* * * * *